US007484652B2

(12) United States Patent
Kalberer

(10) Patent No.: US 7,484,652 B2
(45) Date of Patent: Feb. 3, 2009

(54) DISPOSABLE LID AND HANDLE COMBINATION FOR CONTAINER

(75) Inventor: Roderick W Kalberer, Cincinnati, OH (US)

(73) Assignee: International Paper Company, Loveland, OH (US)

( * ) Notice: Subject to any disclaimer, the term of this patent is extended or adjusted under 35 U.S.C. 154(b) by 292 days.

(21) Appl. No.: 11/211,291

(22) Filed: Aug. 25, 2005

(65) Prior Publication Data

US 2007/0045389 A1 Mar. 1, 2007

(51) Int. Cl.
*B65D 5/46* (2006.01)
*B65D 43/04* (2006.01)

(52) U.S. Cl. ..... 229/117.23; 229/125.03; 229/125.17

(58) Field of Classification Search ..... 229/125.03, 229/125.17, 117.23; 383/25; 220/268, 265, 220/270, 62, 276, 758; 294/87.2
See application file for complete search history.

(56) References Cited

U.S. PATENT DOCUMENTS

| | | | | |
|---|---|---|---|---|
| 2,051,940 | A * | 8/1936 | Chichester-Miles | 220/754 |
| 2,194,898 | A | 3/1940 | Handord | |
| 2,669,379 | A * | 2/1954 | Olson | 220/574 |
| 2,914,826 | A | 12/1959 | Then | |
| 2,935,223 | A * | 5/1960 | Crowley | 220/761 |
| 3,594,891 | A | 7/1971 | Cummingham et al. | |
| 3,628,688 | A * | 12/1971 | Haggard et al. | 220/270 |
| 3,737,069 | A | 6/1973 | Owen | |
| 3,889,732 | A | 6/1975 | Wilkins | |
| 3,961,722 | A * | 6/1976 | Bozek | 220/270 |
| 4,357,042 | A | 11/1982 | Gall | |
| 4,380,304 | A | 4/1983 | Anderson | |
| 4,763,833 | A * | 8/1988 | Stoll | 229/117.12 |
| 4,799,723 | A | 1/1989 | Mahaffy | |
| 5,027,973 | A | 7/1991 | Drogos | |
| 5,215,210 | A | 6/1993 | Ostrum et al. | |
| D431,413 | S | 10/2000 | Schaper et al. | |
| 6,443,325 | B1 | 9/2002 | Schaper et al. | |

FOREIGN PATENT DOCUMENTS

| | | |
|---|---|---|
| EP | 0 019 414 | 5/1980 |
| FR | 2256877 | 1/1974 |
| OA | 2361 A | 3/1967 |
| WO | WO 88/07962 | 10/1988 |
| WO | WO 95/16614 | 6/1995 |

* cited by examiner

*Primary Examiner*—Nathan J Newhouse
*Assistant Examiner*—Christopher Demeree
(74) *Attorney, Agent, or Firm*—Thomas W. Barnes, III

(57) ABSTRACT

A disposable lid and handle combination for a container for food products, for example, and a blank for such combination which is die cut from a sheet of laminated paperboard without generation of inner scrap.

16 Claims, 8 Drawing Sheets

DISPOSABLE LID AND HANDLE COMBINATION FOR CONTAINER

CROSS-REFERENCE TO RELATED APPLICATIONS

Not Applicable

STATEMENT REGARDING FEDERALLY SPONSORED RESEARCH OR DEVELOPMENT

Not Applicable

FIELD OF INVENTION

This invention relates to disposable lids and/or handles for containers such as cups or buckets having an open top end. The container may include a rim defined around the perimeter of its open top end or may be tapered from a minimum perimeter to a greater maximum perimeter at its open top end.

BACKGROUND OF THE INVENTION

Presently in the fast food market food products are at least partially prepared on site and while the consumer waits. Whereas, in many instances the food product is consumed while the consumer is on the premises, it is common and customary for the consumer to place an order for the food product, wait for it to be prepared or assembled and placed in a "carryout" container. In certain instances, the food may be placed in a cup or bucket, a lid applied to the cup or bucket to protect the food product contents of the container, and the lidded container delivered to the consumer for their carrying of the filled container away from the premises for consumption of the food product at a remote location.

The containers most currently employed for these purposes are intended to be disposable, hence their cost to the retail concern is of substantial significance monetarily. The components of the container are often kept to a minimum number to reduce the cost of container. In such containers, neither lids nor handles are provided. It therefore has been heretofore common to form such carryout containers from a plastic material or a laminated paperboard material, either material being chosen, in part, on a cost basis. In each instance, efforts are made to optimize the strength, rigidity, non-porous, and similar properties of a carry out container while all the while attempting to minimize the cost of the container to the retail concern. These efforts have resulted, and continue to result, in carryout containers having undesirable, and at times serious, physical limitations, to the extent that such containers bend, partially collapse, rack or otherwise deform, often resulting in spillage of their food product contents.

In one particular instance, it is common for a consumer to order for carryout 4-5 pounds of food product. The volume and weight of this food product has promoted the use of "buckets", ie., a container having an open top and a side wall which tapers from a minimum circumference of the container sidewall adjacent the bottom of the closed end of the container to a maximum circumference adjacent the open top of the container. Either bucket/cup or like containers may include a top rim which may be in the form of a roll over of the top end of the container, but which is capable of stiffening the top end of the container by a limited amount and at times to provide a closure means for a lid covering the open top of the container.

In one embodiment of such a bucket, the lid is inserted into the open top of the bucket and forced into a circumferential groove defined in the inner wall of the container at a location below and immediately adjacent the open top end of the container in an effort to secure the lid in its closing position relative to the open top end of the bucket and above the food product in the bucket. These prior art buckets do not include a handle and require either two hands or necessitate the use of a secondary paper or polymer bag to allow convenient conveyance of the loaded bucket away from the retail site. The press fit placement of the bucket lid into a grooved score in the bucket inner sidewall further complicates the handling of the loaded bucket because disproportionate compression of the bucket sidewall frequently results in the lid becoming dislodged and falling down on top of the product in the bucket, or even being "flipped" out of the bucket, resulting in possible exposure of the food product to the ambient environment (cooling of heated food product, etc.) and/or spillage of food product from the bucket.

The use of moldable polymeric material for food containers is currently practiced, but suffers from problems of rigidity, torqueing, racking, and environmental concerns, including disposal of the plastic containers. Paperboard, especially laminated paperboard, offers a less expensive material for manufacture of disposable containers and is both consumer and environmentally acceptable.

BRIEF SUMMARY OF THE INVENTION

In accordance with one aspect of the present invention, there is provided a unitary blank, preferably of a flexible, essentially non-extensible in use, paperboard laminate, which defines a disposable lid which is insertable into a open-top cup/bucket or like container for a food product, a disposable flexible, essentially non-extendable in use, girdle for encircling the perimeter of a container at a location adjacent the open top end of the container, and a disposable handle suitable for grasping and carrying of the filled container in an upright attitude. The container may be tapered from the bottom having a first perimeter to a maximum and larger perimeter at its open top end of the container and/or may include a rim defined about the perimeter of its open top end, such rim projecting laterally outwardly of the perimeter of the open top end of the container outer sidewall. In this latter embodiment, the rim may serve as a stop against which the girdle will not pass.

In accordance with a feature of the present invention, a blank defining the lid and handle combination is die cut from a sheet of paperboard, paperboard laminate, plastic or other suitable flexible material. Such die cutting provides for substantially simultaneous formatting of the all elements of the lid and handle combination, all with essentially no inner scrap material.

In the blank, all components of the lid and handle combination are disposed flat and in a common plane. Individual components of the blank may be separated from the blank and placed into use independently of others of the components.

DETAILED DESCRIPTION OF THE INVENTION

Figure 1:
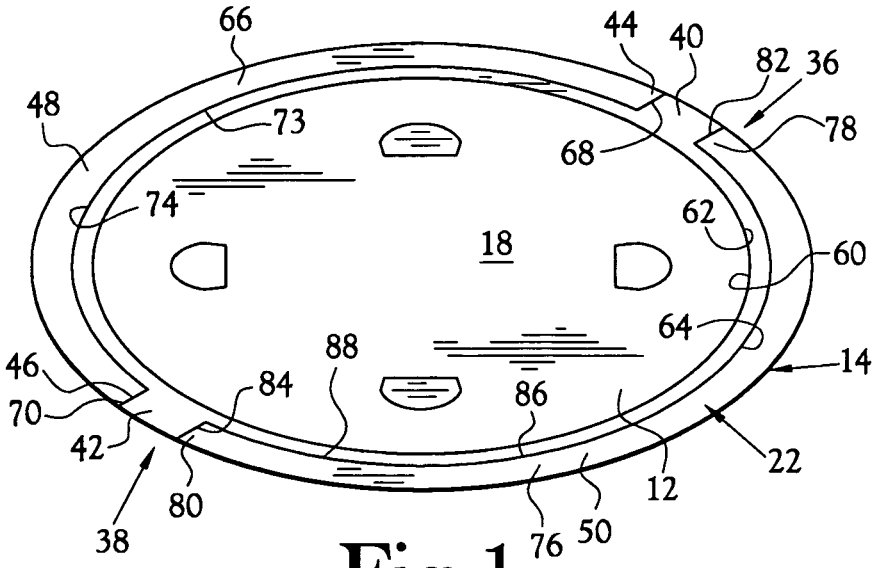
FIG. 1 is a perspective view of a blank from which the present lid and handle combination may be formed employing die cutting of a sheet of material.
Figure 3:
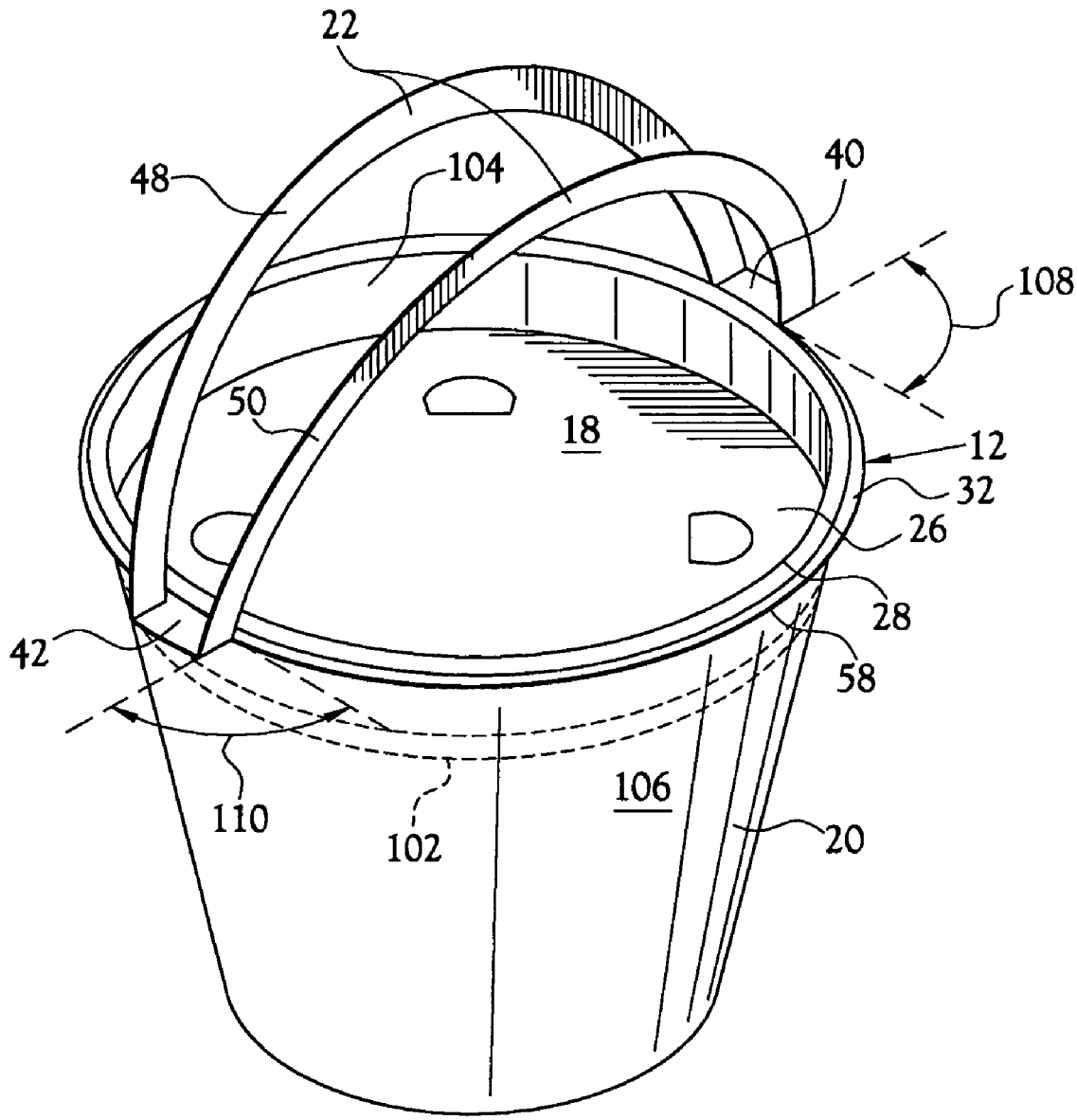
FIG. 3 is a perspective view of a bucket-type container having a lid and handle of the present invention applied thereto.

One embodiment of a lid and handle combination 12 of the present invention, formed from a unitary blank 14 of the present invention, is depicted in FIG. 1 as utilized on a bucket variety container, for example. In the depicted embodiment, there is provided a disposable lid 18 which is insertable into a open-top cup/bucket 20 or like container for a food product, for example, and a disposable handle 22 suitable for grasping and carrying of the filled container in an upright attitude. As depicted in FIG. 3, the container may be tapered from a minimum perimeter at its bottom 24 to a maximum and larger perimeter at the open top end 26. The container may include a rim 28 defined about the perimeter of its open top end, such rim projecting laterally outwardly of the perimeter of the open top end of the container. In the depicted embodiment, the container is formed of a laminated paperboard material, for example.

Figure 2:
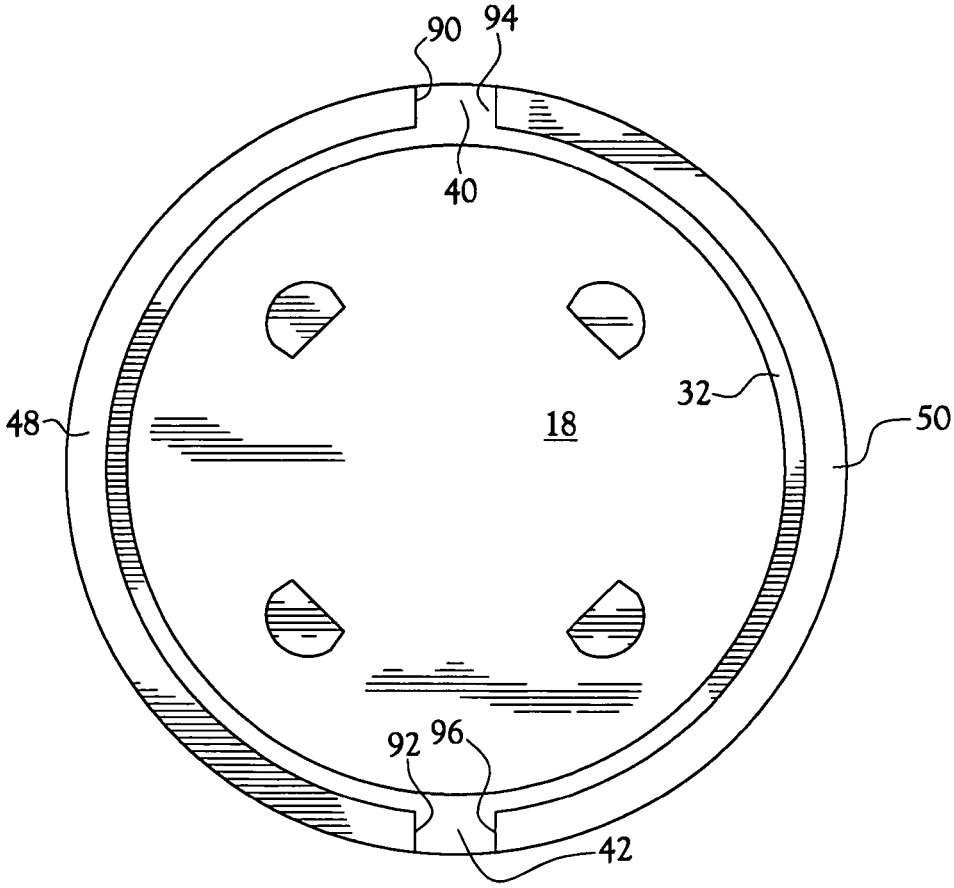
FIG. 2 is a top plan view of the blank depicted in FIG. 1.

The lid and container combination, embodiments of which are depicted in the several FIGS. 1 and 2 derives from a blank which is die cut from a sheet of laminated paperboard such as clay coated or polyethylene coated paperboard. One such blank is depicted in FIGS. 1 and 2 and comprises a circular lid 18, a girdle 32 which is designed to intimately encircle the container adjacent its open top end immediately below the rim of the container. In one embodiment, the girdle is an elongated flat strip 34 of paperboard material. At diametrically opposite lateral regions 36,38 of the girdle there are provided first and second protrusions 40,42. These protrusions serve as the anchor locations for the opposite ends 44,46 of first and second flat paperboard strips defining first and second handle elements 48,50, respectively, which initially lie within the same plane as the girdle and which are readily bendable into an upright attitude above and extending across the lidded container in rainbow fashion to define the handle 22 (See FIG. 5). The circumference of the girdle is chosen to create a fit, commonly frictional, of the girdle about the outer circumference 56 of the container (See FIG. 3) at a location immediately adjacent and below the open top end of the container such as precludes passage of the girdle off the open top end 26 of the container. Alternatively, or in addition, the girdle may be stopped from passing off the open top end of the container by a rim 28.

In accordance with one feature of the present invention, the lid and handle combination 12 of the present invention is derived from a flat planar blank 14 of a flexible paperboard laminate material which is die stamped to substantially simultaneously form an integrated lid 18, girdle 32 and first and second handle elements 48,50, from a sheet of the paperboard with essentially no generation of inner scrap.

In this blank, the lid 18 is circular in plan view and is central of the blank. Radially outwardly of and immediately adjacent to the lid there is defined a girdle 32, the inner circumference 60 of the girdle being coextensive with the outer circumference 62 of the lid. At opposite diametrically opposed locations along the girdle, there are defined first and second protrusions 40,42 of limited circumferential length, that are formed integrally with and project radially outwardly of the girdle. Further, in the blank the outer circumference of the lid is releasably attached to the mating inner circumference of the girdle by readily rupturable tabs 98 (See FIG. 4) spaced at one or more locations about the outer circumference 62 of the lid, for example. In like manner, each of the handle elements is releasably attached to the girdle by like rupturable tabs 100 spaced at one or more locations about the outer circumference 64 of the girdle.

In the present blank, each of the first and second handle elements 48,50 comprises a flat curved strip 66 of paperboard having a first one 44 of its opposite ends 44,46 integrally formed with a first lateral side 68 of a first one 40 of the protrusions on the girdle. This first handle element extends about substantially half of the outer circumference of the girdle (when in blank form) and its second and opposite end is likewise integrally formed with a first lateral side 70 of a second one 42 of the protrusions at a location approximately diametrically across the blank. In the blank, viewed in a top plan view, the first handle element curves coextensively with the girdle and lies alongside a respective portion of the girdle with the inner edge 73 of the first handle element sharing a common curved cut line 74 with that portion of the girdle which extends between the first lateral side of the first protrusion and the first lateral side of the second protrusion.

The second handle element extends about the outer circumference of the girdle opposite the first handle element. Like the first handle element, the second handle element comprises a flat curved strip 76 of paperboard having one 78 of its opposite ends 78,80 integrally formed with a second lateral side 82 of a first one 40 of the protrusions on the girdle. This second handle element extends about a respective portion of the outer circumference of the girdle, opposite the first handle element, and its second and opposite end 80 is likewise integrally formed with a second lateral side 84 of a second one 42 of the protrusions at a location approximately diametrically across the blank. In the blank, viewed in a top plan view, the inner edge 86 of the second handle element curves coextensively with a respective portion of the girdle and lies alongside the girdle with the inner edge of the second handle element sharing a common curved cut line 88 with that portion of the girdle which extends between the second lateral side of the first protrusion and the second lateral side of the second protrusion.

In a preferred embodiment, the junctures 90,92,94, and 96 between each end of the first and second handle elements 48,50 with respective ones of the first and second lateral sides of respective ones of the protrusions are defined by score lines. By reason of the sharing of perimetral edges of each of the components of the girdle and handle elements of the blank, these elements may be readily die cut from a sheet of material substantially simultaneously with the concentric girdle having diametrically disposed protrusions, and first and second handle elements.

In the depicted embodiment, the handle elements are integrally formed with the protrusions which, in turn are integrally formed with the girdle. Preferably, the noted components of the blank are die cut substantially simultaneously with no generation of scrap laminated paperboard inside the outer perimeter of the blank. This feature of the present invention contributes materially toward reduction of the cost of manufacture of the lid and the handle combination, thereby rendering the combination most cost effective in the marketplace. Further, the ability to die cut all the components of the combination in a single die cutting step contributes to the lowering of the manufacturing cost of the combination. Still further, the ability to die cut the blank essentially eliminates errors in the dimensions of each of the components, thereby ensuring each lid and handle combination will perform satisfactorily when applied to a container. Even further, the ability to generate the lid and handle combination as an integrated planar product permits inexpensive package and shipping of the planar units and economical storage of the units at their site of use. Through the die cutting procedure of the present invention, the lid is retained within the blank until it is needed for closing a container. Likewise, once the lid is detached, there remains the girdle and its affixed handle elements, also ready for use.

As noted, the lid and handle combination is die cut from a sheet of laminated paperboard, all the components of the combination being die cut substantially simultaneously, employing conventional die-cutting equipment. This procedure is made possible by the present invention in which the circular lid 18 is disposed most centrally of the blank 14. Proceeding radially outwardly of the plane of the flat blank from the central lid, there is defined an initially flat circular member which defines a girdle 32 having its inner circumference coextensive with the outer circumference of the lid. Thus, the lid and girdle share a common die cut line, leaving no scrap therebetween.

Radially outwardly of the girdle, there are defined first and second handle elements. Each handle element comprises a flat strip which is curved to lie along a portion, substantially along one-half, of the outer circumference of the girdle. As seen in FIG. 2, the girdle is provided with first and second protrusions which are spaced substantially diametrically apart from one another and each of which project radially outwardly of the girdle. These protrusions provide locations for anchoring of the first and second handle elements to the girdle. More specifically, each protrusion includes first and second lateral opposite sides. As depicted, all within the plane of the flat blank, the first handle element is curved to lie along the outer circumference of the girdle. The first end of the first handle element is integrally formed with the first lateral side of the first protrusion of the girdle and extends therefrom around the circumference of the girdle to be integrally formed with the first lateral side of the second protrusion. Along the length of the first handle element, this element shares a die cut line defined between the outer circumference of the girdle and the inner perimeter of the first handle element.

Like the first handle element, the second handle element is curved to lie along the outer circumference of the girdle. The first end of the second handle element is integrally formed with the second lateral side of the first protrusion of the girdle and extends therefrom around the circumference of the girdle to be integrally formed with the second lateral side of the second protrusion. Along the length of the first and second handle elements, they share respective die cut lines defined between the inner circumference of each handle element and its respective portion of the outer circumference of the girdle. Again no inner scrap is generated in the die cutting of the protrusions and the handle elements.

Along the die cut line defined between the outer circumference of the lid and the inner circumference of the girdle, there are provided spaced apart uncut connecting tabs 98. Each such tab is readily rupturable to permit quick and clean separation of the lid as desired, but which retain the lid within the blank from its source of production to its end use site. It will be noted that once the lid is removed from the blank there remains the girdle and its integrally formed handle elements. Like uncut connector tabs 100 are also provided at spaced apart locations along the cut line between each segment of the girdle and its associated handle element. Thus, in use, the lid may be removed from the blank while leaving the girdle and its handle elements in their common plane.

Figure 4:
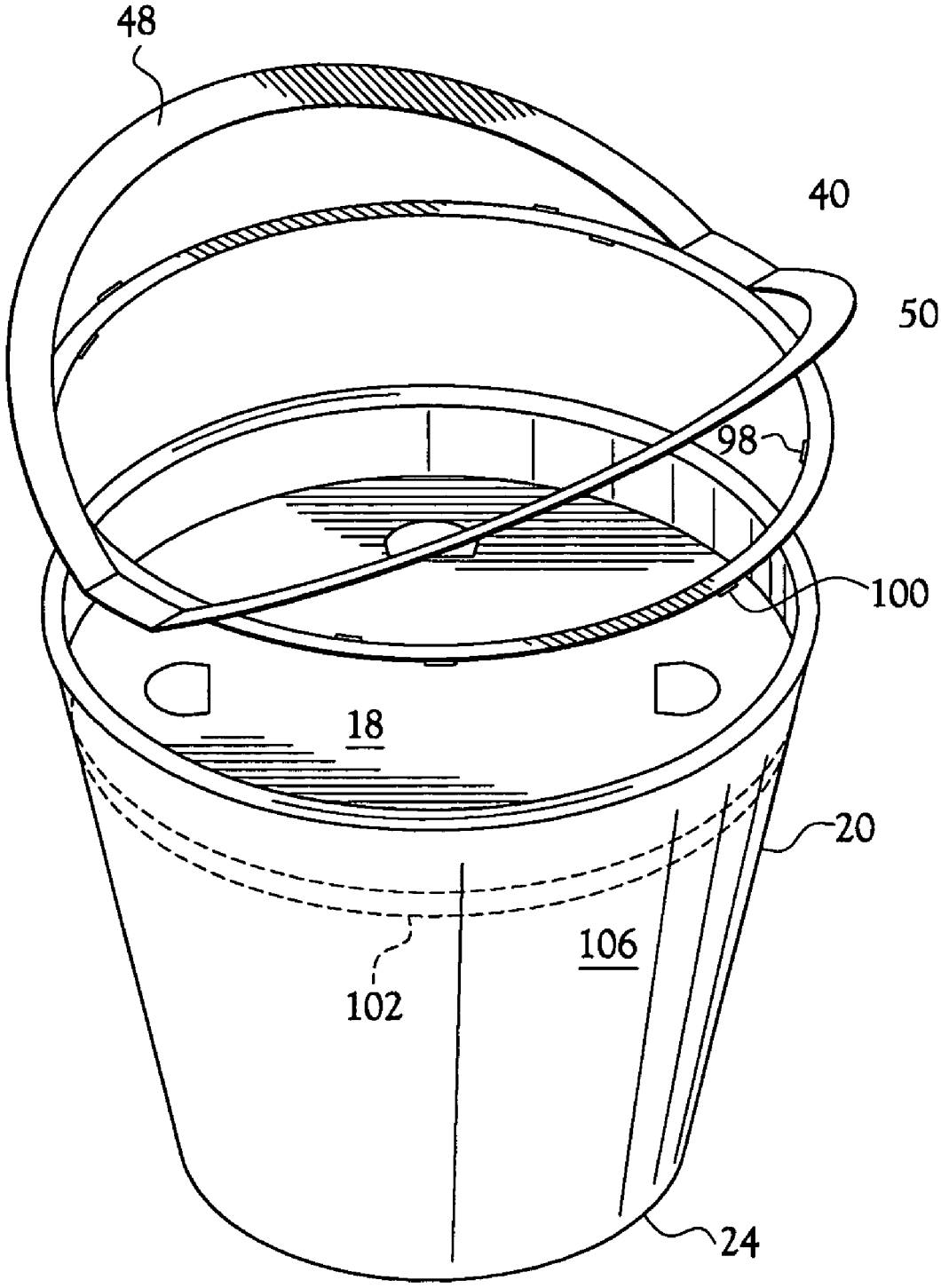
FIG. 4 is a perspective view as in FIG. 3, partly exploded, with the first and second handle portions initially bent upwardly over the top end of the bucket container.
Figure 5:
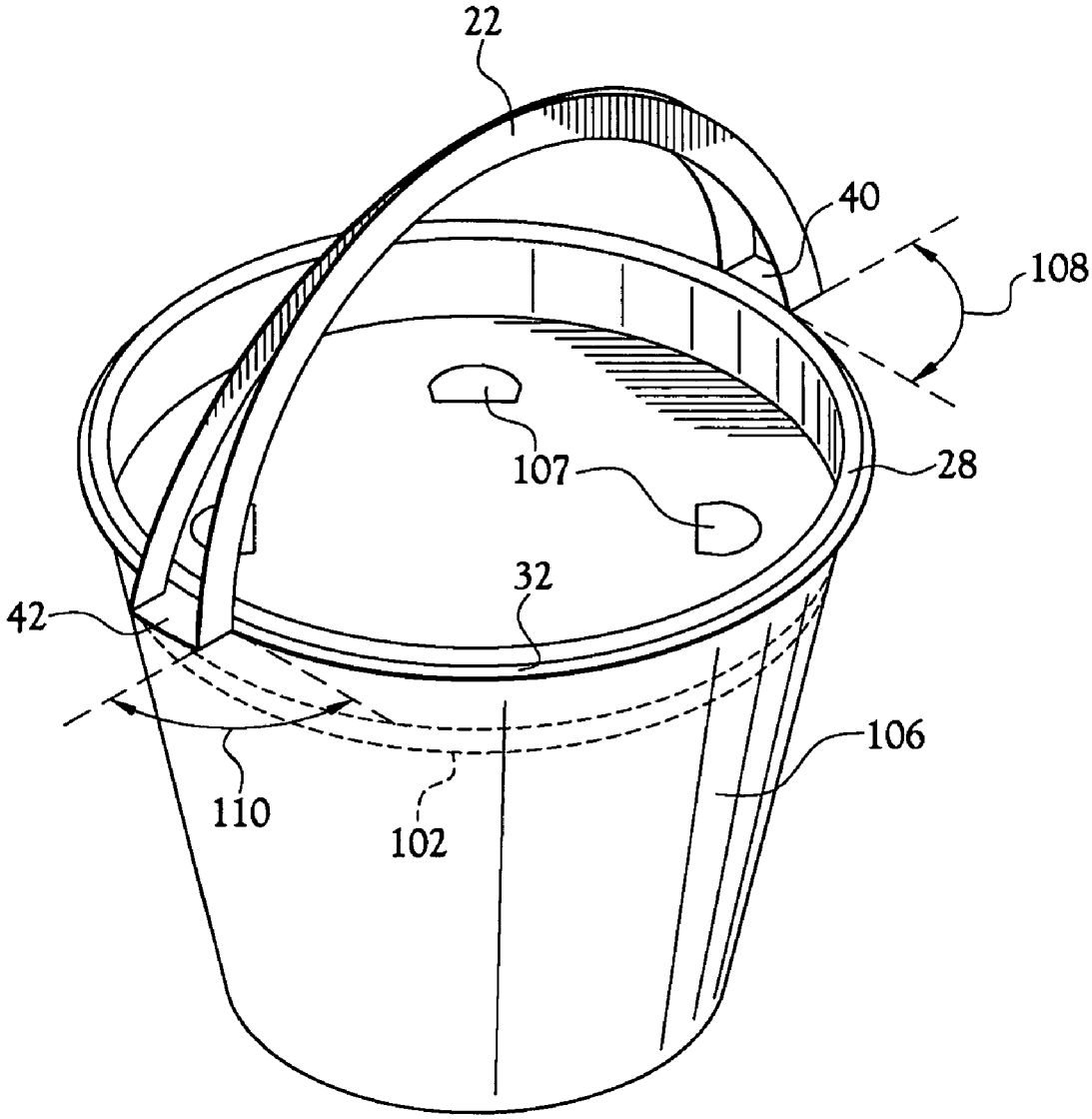
FIG. 5 is a perspective view as in FIG. 3 with the first and second handle portions in their ultimate lifting attitudes with respect to the open top end of the bucket container.
Figure 6:
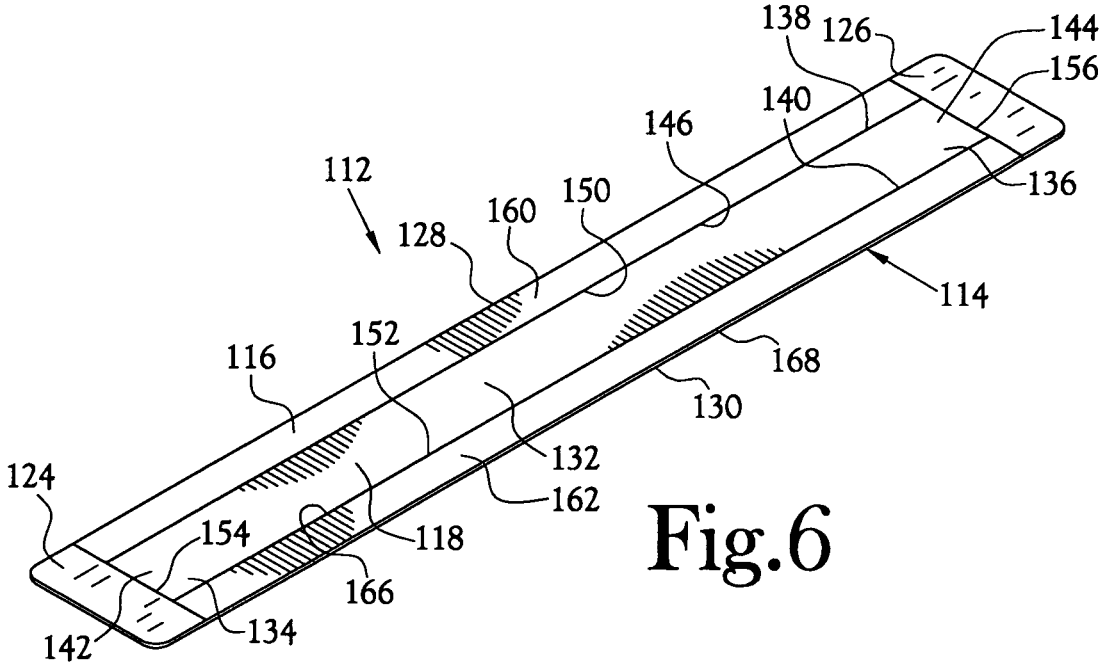
FIG. 6 is a perspective view of a blank defining one embodiment of a girdle/handle combination.
Figure 7:
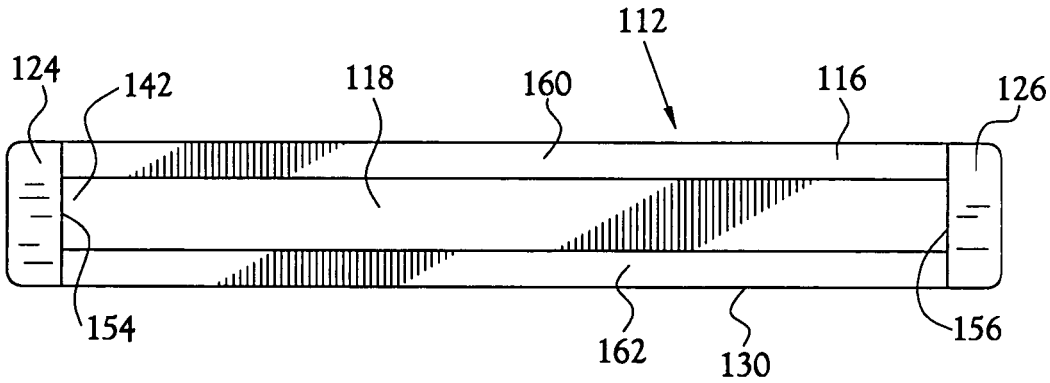
FIG. 7 is a top plan view of the blank depicted in FIG. 6.

Referring to FIGS. 3-5, in use, the lid of a blank as described hereinabove is "punched" out of a blank and inserted into the open end of a bucket type container. In the depicted embodiment, the container includes a circumferential groove 102 formed around the inner sidewall 104 of the container at a location below and immediately adjacent to the open top end of the container. Thereafter, or before the placement of the lid within the container, the girdle and its handle elements (with the lid being removed) are slid over the bottom of the bucket and upward toward the open top end of the container until the girdle snugly encircles the outer sidewall 106 of the container at a location below and immediately adjacent the open top end of the container. This location may be at or near the same vertical level as the lid disposed within the container. The girdle and its handle elements of the present invention may be employed with tapered containers in which instance, the inner circumference 60 of the girdle is chosen to frictionally engage the outer sidewall of the container at that level where the dimension of the outer perimeter of the container substantially equals the inner perimeter of the girdle, thereby prohibiting the girdle from sliding past the open top end of the container. In other instances, the container may be provided with a rim defined along the perimeter of its open top end, such rim projecting radially outwardly of the open top end of the container to define a stop against movement of the girdle past the open top end of the container.

In accordance with one aspect of the present invention, at the use site, the lid is separated from the girdle and its handle elements, for example, by placing fingers in any number of the holes 107 that may be cut into of the lid. First, the girdle and its handle members are fitted onto the outer sidewall of the container at that vertical level where the girdle is frictionally retained in encircling relationship to the open top end of the container. At this stage, the handle members remain disposed within a common plane with the girdle. The container next is filled to the desired extent with a food product or the like and the lid is "snapped" into the circumferential groove in the inner sidewall of the container to close the open top end of the container. Thus, the holes 107 may act as vents for the food filled in the container. As thus disposed, the girdle contributes to the rigidity of the upper end of the container and discourages warping, torqueing or racking of the container.

Importantly, after the container is filled and lidded, each of the handle elements is pulled upwardly to disengage the central portion of each handle element from its respective adjacent portion of the girdle. Thereupon the central portion of each handle element is pulled upwardly to bring the first and second handle elements toward one another over the top end of the container in "rainbow" fashion. These arched handle members are grasped in a user's hand and a lifting force is applied. This lifting force enhances the frictional fit of the girdle about the container and being located adjacent the top end of the container, maintains the container in the desired upright attitude for transport. Employing two handle elements which are anchored at diametrically opposed locations relative to the top end of the container, the container is further stabilized against overturning, warping, torqueing or racking, even with a relatively heavy load within the container.

The juncture of each end of each of the handle elements with respective ones of the protrusions on the girdle preferably is provided with a line of weakness which enhances the upward folding of the handle elements. Moreover, as each handle element is pulled upwardly away from the girdle, each of the flexible protrusions twists to relocate the line of joinder of the ends of the handle elements with the protrusions from a planar attitude (as in the blank) to positions that extend at substantially right angles 108,110 to the plane of the girdle encircling the container (See FIG. 5), for example. This action at these junctures has been noted to also enhance the frictional engagement of the girdle with the outer sidewall of the container, in the fashion of a tightening of the girdle about the circumference of the container.

One embodiment of a girdle and handle combination 112 (without a lid element) is depicted in FIGS. 6-9, wherein there is shown a blank 114 designed for die cutting formation of the girdle and handle combination without generation of inner scrap paperboard material. In this depicted embodiment, the blank preferably comprises a sheet of flexible, essentially non-extensible, paperboard laminate. The blank defines a unitary girdle 116 and a handle element 118 of generally rectangular geometry in the form of a unitary elongated flat strip 132 having first and second opposite ends 124,126 and first and second opposite outer sides 128,130.

In the center of the rectangular girdle there is defined a further flat strip 132 which is the handle 118 of the combination. This flat strip (handle) is also of substantially rectangular geometry having first and second opposite ends 134,136 and first and second opposite sides 138,140. In the blank, the girdle and handle lie in a common plane and are oriented substantially parallel to one another with their respective opposite ends being substantially coterminal. In the depicted embodiment, these coterminal ends define first and second diametrically opposed locations for the junctures 142,146 of the first and second ends 134,136 of the handle element with respective ones of the opposite ends 124,126 of the girdle. In the blank, the presence of the handle centrally of the girdle divides the girdle into first and second parallel leg portions 160,162, each leg portion extending between the first and second opposite ends of the girdle. This girdle thus becomes defined as a rectangular ring which encircles the handle. As a result, the first side 138 of the handle element shares a die cut line 150 with a first inner side 146 of the first leg 160 of the girdle and the second side 140 of the handle element shares a die cut line 152 with the second inner side 166 of the girdle, thereby providing for no inner scrap of paperboard material within the blank.

Each of the junctures 142,144 of the ends of the handle element with the first and second ends of the girdle element is provided with a line of weakness, e.g. a score line 154,156, which enhances the bending of the handle element out of the plane of the blank, as well as enhancing the face-to-face alignment of a flat surface 168 of the girdle element with the outer perimeter of a container onto which the combination is applied.

Figure 8:
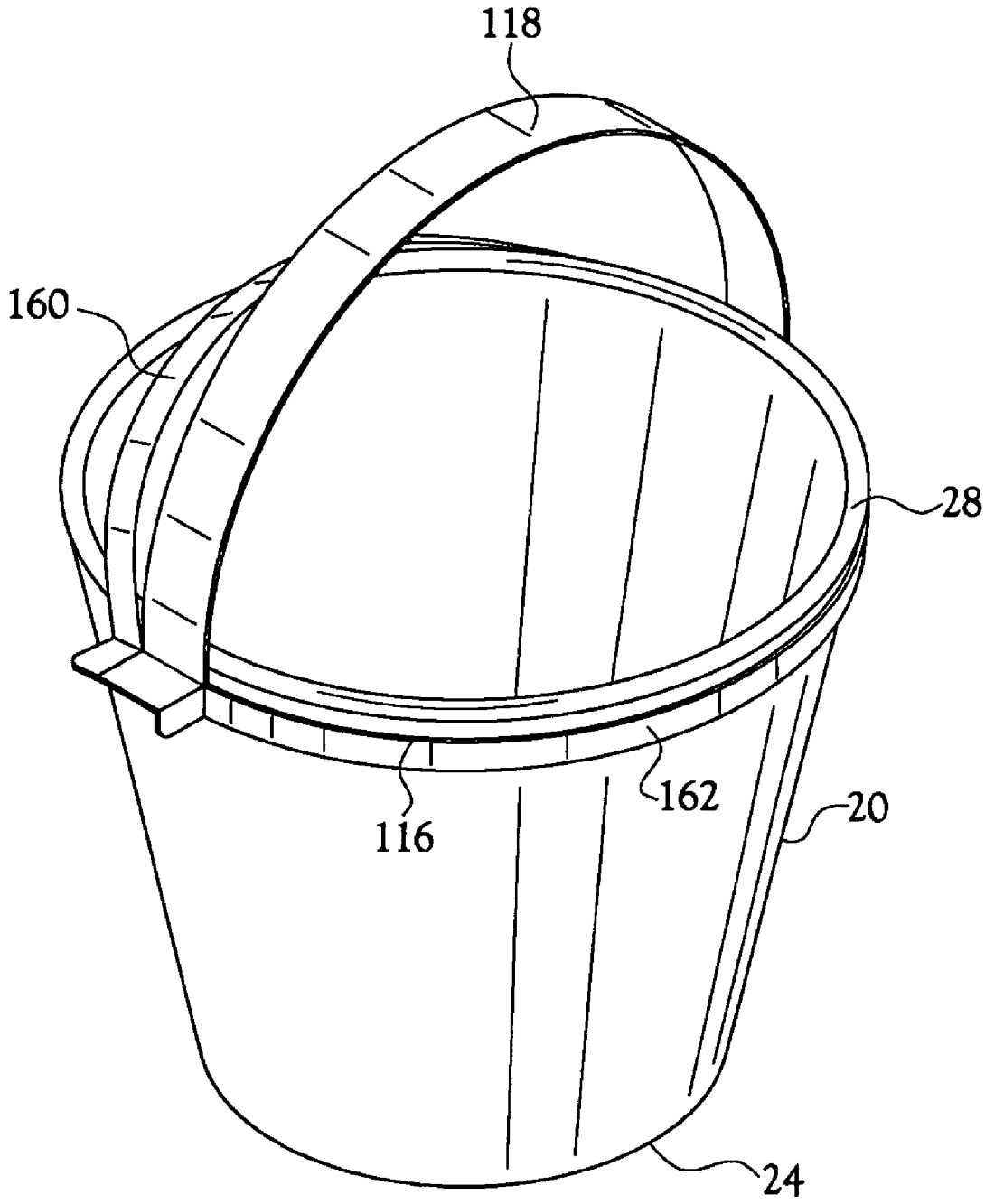
FIG. 8 is a perspective view of a cup/bucket type container having partially applied thereto a girdle/handle combination formed from the blank depicted in FIG. 6.
Figure 9:
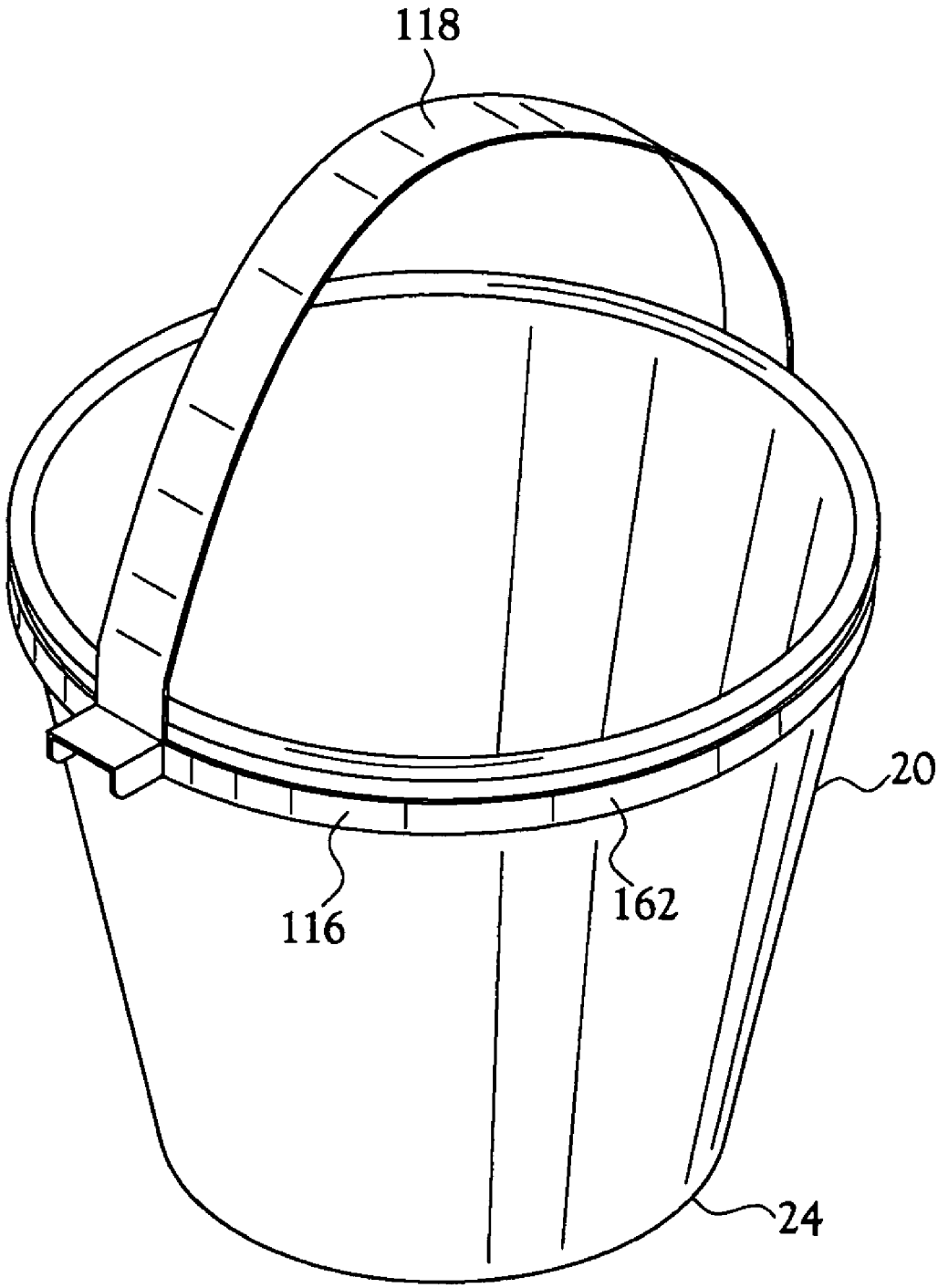
FIG. 9 is a perspective view of a cup/bucket type container having applied thereto a girdle/handle combination formed from the blank depicted in FIG. 6, and showing the handle under load; and, FIG. 10 is a view of a container having a non-circular perimeter and fitted with a girdle/handle and lid combination of the present invention.
Figure 10:
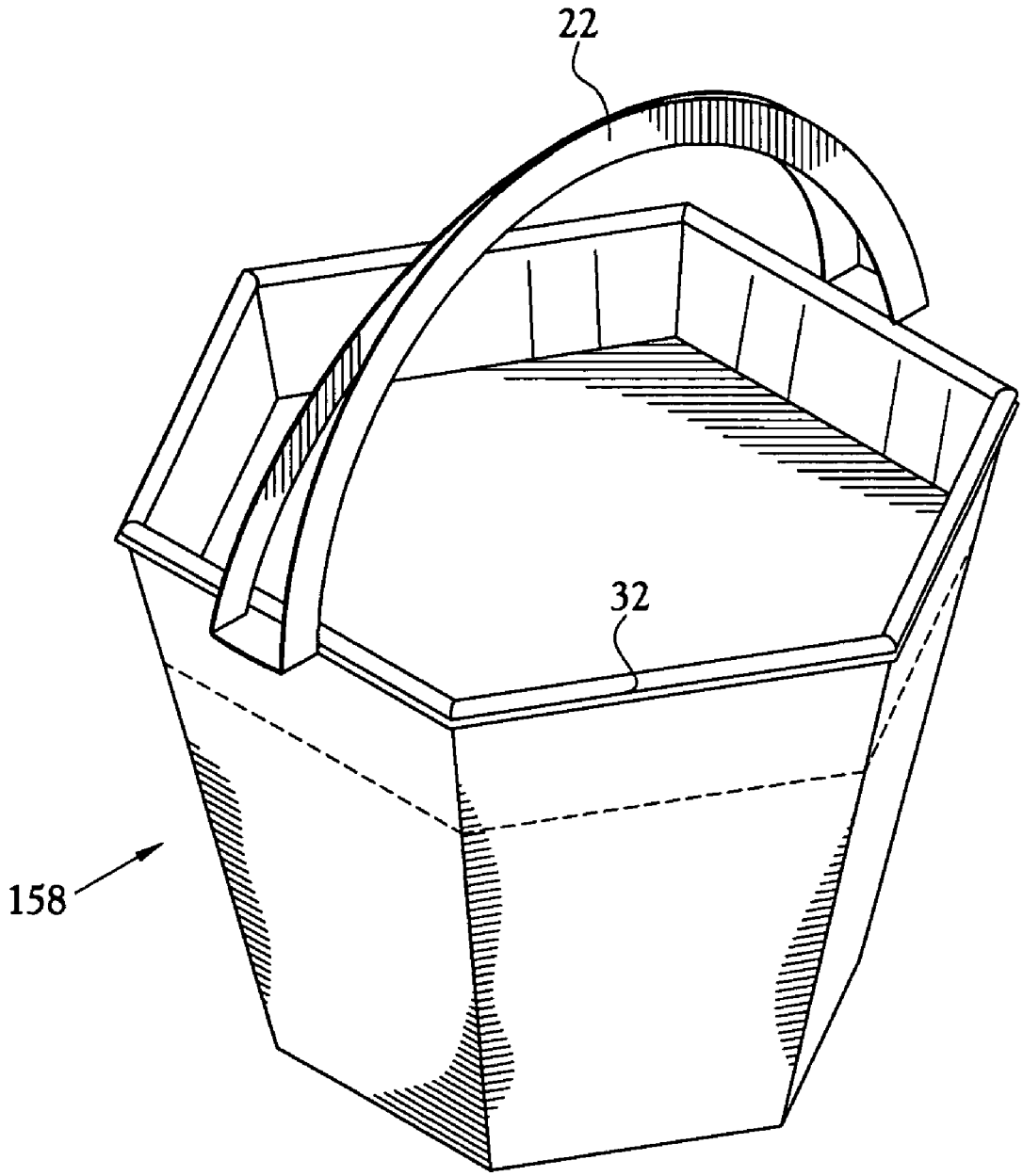

With reference to FIGS. 8 and 9, application of the girdle/handle combination (no lid) onto a container may be effected by first pulling the handle element out of the plane of the blank. This action tends to rotate the girdle element out of the plane of the blank and toward an attitude wherein the flat girdle strip is oriented at about a right angle with respect to the plane of the blank. This action effectively enlarges the inner circumference of the girth.

Thereupon, as seen in FIG. 8, one leg portion 162 of the reoriented girdle is slipped down over the rim of the open top end of a container, followed by like slipping of the opposite leg portion 160 of the girdle over the rim of the open top end of the container. Thereafter, as depicted in FIG. 9, application of a lifting force via the handle, tightens the girdle about the outer circumference of the container at a location below the rim so that the girdle is precluded by the rim from sliding off the open top end of the container.

Whereas the present invention has been described herein in terms of a container having a round outer perimeter, it will be recognized that the lid and handle combination or the girdle and handle combination may be employed with a container having a perimeter which is non-circular, such as a multi-sided container 158. In the present invention, the flexibility of the flat strip which defines the girdle of the combination permits the deformation of the girdle to the extent that its "fits" snugly about a non-round perimeter of a container.

What is claimed:

1. A blank for the formation of a lid and handle for a container of the cup/bucket type having an open top end comprising a flat planar sheet of material of construction of the lid and handle, a unitary die cut pattern, said pattern defining a circular member having an outer circumference and being disposed most central of said die cut pattern;

a girdle comprising a flat strip extending around the outer circumference of said lid, said girdle having an inner circumference which is coextensive with said outer circumference of said lid, said inner and outer circumferences sharing a common cut line;

first and second protrusions integrally formed with said girdle at locations substantially diametrically opposed across said girdle, each of said protrusions including a first lateral side and an opposite second lateral side, a first handle element having a first end integrally formed with said first lateral side of said first protrusion and extending coextensively with said outer circumference of said girdle between said first and second protrusions and with a second end thereof being integrally formed with said first lateral side of said second protrusion, said first lateral side and said outer circumference of said girdle sharing a common cut line;

a second handle element having a first end integrally formed with said second lateral side of said first protrusion and extending coextensively with said outer circumference of said girdle between said first and second protrusions and with a second end thereof being integrally formed with said second lateral side of said second protrusion, said second lateral side and said outer circumference of said girdle sharing a common cut line; and said first and second ends of each of said first and second handle elements being foldable about their respective junctions with said protrusions into positions substantially perpendicular to said plane of said blank, wherein said blank is a single unitary blank of paperboard.

2. The blank of claim 1 wherein said lid includes multiple uncut tearable connecting tabs spaced apart along the outer circumference of said lid and extending between said outer circumference of said lid and said inner circumference of said girdle.

3. The blank of claim 1 wherein said outer circumference of said girdle includes at least uncut tearable connecting tabs spaced intermediate each of said handle elements along the outer circumference of said girdle and extending between said outer circumference of said girdle and said inner perimeter of each of said first and second handle elements.

4. The blank of claim 1 and including at least one punch-out through the thickness of said lid.

5. A lid and handle combination for a container formed from a blank of claim 1.

6. A lid and handle combination for a container formed from a blank of claim 1 and comprising ruptured connecting tabs between each segment of the girdle and its associated handle element.

7. A lid and handle combination for a container formed from a blank of claim 1 and comprising ruptured connecting tabs between the lid and the girdle.

8. A lid and handle combination for closing the open top end of a cup/bucket type container and providing means for ready transport of said container having a product contained therein comprising a flat lid having an outer circumference adapted to be disposed in closing relationship to the container at a location below and immediately adjacent the open top end of the container, a girdle comprising a flexible flat strip of laminated paperboard and having an overall length adapted to provide frictional encircling of the container by said girdle at a location below and immediately adjacent the open top end of the container, said girdle having first and second flat protrusions projecting from respective locations spaced diametrically apart from one another, each of said protrusions including first and second lateral sides, a first flat strip of flexible laminated paperboard formed integrally with said girdle and extending coextensively with that portion of said girdle which extends between said respective ones of said first lateral sides of said first and second protrusions, said first flat strip having a first end integrally formed with said first lateral side of said first protrusion and a second end integrally formed with said first lateral side of said second protrusion, thereby defining a first handle element, a second flat strip of flexible laminated paperboard extending coextensively with that portion of said girdle which extends between said respective ones of said second lateral sides of said first and second protrusion, said first flat strip having a first end integrally formed with said second lateral side of said first protrusion and a second end integrally formed with said second lateral side of said second protrusion, thereby defining a second handle element which are mirror images of one another, whereby each of said handle elements is bendable out a plane containing said girdle to define, in combination, means for lifting and/or transporting said container in an upright attitude, wherein each of said lid, said girdle and said first and second handle elements is die cut from a single flat unitary sheet of paperboard with no scrap being generated internally of the die cut.

9. The lid and handle combination of claim 8 wherein said flat girdle includes a longitudinal axis and is flexible and when applied to a container, is rotated about its longitudinal axis such that said girdle lies flat against an outer circumferential wall of the container at a location below and immediately adjacent the open top end of the container.

10. The lid and handle combination of claim 9 and including a line of weakness defined at each of the locations of integral formation of each of the ends of said first and second lateral side edges of respective ones of said protrusions.

11. The lid and handle combination of claim 8 wherein said lid and handle combination is independent of said container and, prior to application of said lid and handle combination to the container, said lid, said girdle, said protrusion and said handle elements occupy a common plane.

12. The lid and handle combination of claim 11 and including break-away connections between said lid and said girdle and between said girdle and said handle elements.

13. The lid and handle combination of claim 8 wherein said lid, said girdle, said protrusions and said first and second handle elements, prior to application of one or mare of said components to the container, are disposed concentrically of one another in a common plane.

14. The lid and handle combination of claim 8 wherein the container tapers in circumference between a minimum circumference to a maximum circumference at the open top end of the container.

15. The lid and handle combination of claim 8 wherein said lid is readily separable from said girdle and said handle elements integrally formed therewith and said lid is insertable into the container for establishing a closure of the container below and immediately adjacent the open top end of the container.

16. The lid and handle combination of claim 15 wherein said girdle is adapted to encircle the container at a location proximate the location of said lid within the container.

* * * * *